US008911270B2

(12) United States Patent
Ambrosy et al.

(10) Patent No.: US 8,911,270 B2
(45) Date of Patent: Dec. 16, 2014

(54) CLAMPING BODY FOR AN ELECTRIC CONDUCTOR

(75) Inventors: Uwe Ambrosy, Bodenwerder (DE); Michael Schaefer, Immenhausen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 36 days.

(21) Appl. No.: 13/809,593

(22) PCT Filed: Jul. 8, 2011

(86) PCT No.: PCT/EP2011/003422

§ 371 (c)(1), (2), (4) Date: Jan. 11, 2013

(87) PCT Pub. No.: WO2012/007136

PCT Pub. Date: Jan. 19, 2012

(65) Prior Publication Data

US 2013/0115827 A1 May 9, 2013

(30) Foreign Application Priority Data

Jul. 13, 2010 (DE) ..... 10 2010 027 082

(51) Int. Cl.

| | |
|---|---|
| ***H01R 13/02*** | (2006.01) |
| ***C22C 21/00*** | (2006.01) |
| ***C22C 21/08*** | (2006.01) |
| ***H01R 4/36*** | (2006.01) |
| ***H01R 13/03*** | (2006.01) |

(52) U.S. Cl.

CPC ..... *C22C 21/00* (2013.01); *C22C 21/08* (2013.01); *H01R 4/36* (2013.01); *H01R 13/03* (2013.01)

USPC ..... 439/887; 439/801

(58) Field of Classification Search

CPC ..... C22C 21/00; C22C 21/08; H01R 4/36; H01R 13/03

USPC ..... 439/801–810, 883–887; 148/690, 417

See application file for complete search history.

(56) References Cited

U.S. PATENT DOCUMENTS

| | | | | |
|---|---|---|---|---|
| 2,193,202 | A * | 3/1940 | Millermaster | 439/737 |
| 3,516,049 | A * | 6/1970 | Goodridge | 439/798 |
| 4,042,424 | A | 8/1977 | Nicoud | |

FOREIGN PATENT DOCUMENTS

| | | | |
|---|---|---|---|
| GB | 718602 | A | 11/1954 |
| SU | 449967 | A1 | 11/1974 |

(Continued)

OTHER PUBLICATIONS

Database WPI, Week 197530, Thomson Scientific, London, GB; AN 1975-50522W, XP00000658695, & SU 449 967 A1 (Toldbukht G E) Dec. 15, 1974.

(Continued)

*Primary Examiner* — Khiem Nguyen

(74) *Attorney, Agent, or Firm* — Leydig, Voit & Mayer, Ltd.

(57) ABSTRACT

A clamping body for an electric conductor, comprising a clamping body pocket that forms a receiving space for receiving the electric conductor. A threaded bore is formed in a lateral wall of the clamping body pocket in order to receive a screw. The aim of the invention is to devise a solution in which the clamping body substantially has the properties of a clamping body that is made of art alloy containing brass and simultaneously complies with the EU guidelines and regulations prohibiting certain materials. This is achieved in that the clamping body pocket is formed from an alloy containing aluminium, said alloy having a tensile strength of 380 N/mm$^2$ to 480 N/mm$^2$.

10 Claims, 1 Drawing Sheet

(56) References Cited

FOREIGN PATENT DOCUMENTS

| | | |
|---|---|---|
| WO | WO 8802411 A | 4/1988 |
| WO | WO 9412677 A1 | 6/1994 |

OTHER PUBLICATIONS

European Patent Office, International Search Report in International Patent Application No. PCT/EP2011/003422 (Sep. 26, 2011).

* cited by examiner

CLAMPING BODY FOR AN ELECTRIC CONDUCTOR

CROSS-REFERENCE TO RELATED APPLICATIONS

This application is a U.S. national phase application under 35 U.S.C. §371 of International Application No. PCT/EP2011/003422, filed on Jul. 8, 2011, and claims benefit to German Patent Application No. DE 10 2010 027 082.2, filed on Jul. 13, 2010. The international application was published in German on Jan. 19, 2012, as WO 2012/007136 A1 under PCT Article 21(2).

FIELD

The invention relates to a clamping body for an electric conductor comprising a clamping body pocket that forms a receiving space for receiving the electric conductor, a threaded bore being formed in a lateral wall of the clamping body pocket to receive a screw.

BACKGROUND

Clamping bodies of this type formed as a screw connection are, for example, used in electric terminals, such as terminal blocks or lustre terminals. Electric terminals with a screw connection are distinguished by their high clamping forces that can be transmitted constantly to electric conductors over many years. With this type of terminal, predetermined high clamping forces can be maintained without fluctuations even when vibrations act on the electric terminal. Because of these properties, electric terminals with a screw connection are also preferably used in demanding industrial applications with moving and vibrating machine parts.

The clamping body is generally arranged in an insulating material housing to form an electric terminal. The clamping body pocket of the clamping body may be formed from an electrically conductive material. A threaded bore, which is guided into the receiving space of the clamping body and in which a screw is inserted, is formed on a lateral wall of the clamping body pocket. The screw head of the screw is accessible via an opening provided in the insulating material housing, so the screw can be screwed with its tip into the receiving space and can clamp an electric conductor introduced therein. However, it is also possible, upon an actuation of the screw, for the screw to pull the clamping body upwardly and to press the conductor against a current bar, so no direct contact takes place between the conductor and screw.

The clamping body pocket may be produced from a bent strip-like sheet metal element, which is bent or folded in accordance with the contour of the clamping body pocket. A steel material or a material having a brass-containing alloy is generally used for a clamping body pocket of this type. Furthermore, the clamping body pocket may be produced from a solid profile that is correspondingly machined by cutting methods, such as, for example, sawing, drilling, milling, reaming, thread cutting, in order to obtain the shape of the clamping body pocket. Compared to a clamping body pocket produced from a bent strip-like sheet metal element, the clamping body pocket produced from a solid profile has a more uniform outer contour, as no folding or bending points have to be provided. In addition, a clamping body pocket produced from a solid profile can be formed with smaller dimensions than a clamping body pocket produced from a bent strip-like sheet metal element, so the space requirement of the clamping body pocket can be reduced. In addition, clamping body pockets produced from a solid profile can have a longer threaded bore, so a higher torque, and therefore a higher axial force, can be applied by means of the screw introduced in the threaded bore on the electric conductor clamped by means of the screw. A clamping body pocket formed from a solid profile generally consists of a brass-containing alloy, which has an improved strength and a higher corrosion resistance relative to a clamping body pocket made of steel. In order to improve the machining, in particular in relation to the cutting machining, of the brass-containing alloy, it is conventional to provide the material of the clamping body, and therefore the brass-containing alloy, with lead or to use lead-containing brass alloys. These additions of lead are, however, disadvantageous when it is a question of satisfying the EU guidelines for lead-free products (regulations prohibiting certain materials in the electrical industry or the regulations relating to scrap vehicles). In addition, the production of clamping bodies with a brass-containing alloy is relatively expensive.

The invention is based on the object of providing a solution, in which a clamping body substantially has the properties of a clamping body produced from a brass-containing alloy and simultaneously complies with the EU guidelines and the regulations prohibiting certain materials.

SUMMARY

The object is achieved according to the invention by the features of claim 1. Advantageous configurations of the invention are given in the subordinate claims.

DETAILED DESCRIPTION

This object is achieved in a clamping body of the type described in more detail at the outset in that the clamping body pocket is formed from an aluminium-containing alloy, which has a tensile strength of 380 N/mm$^2$ to 480 N/mm$^2$.

It has surprisingly been found that when using an aluminium-containing alloy with a tensile strength of 380 N/mm$^2$ to 480 N/mm$^2$ for a clamping body pocket, substantially the same properties can be achieved as when using a brass-containing alloy provided with an addition of lead. In particular, an equally good machinability of the material can be achieved without additions of lead being necessary. Since an alloy is now used, which has no additions of lead, the clamping body according to the invention or the clamping body pocket of the clamping body satisfies the EU guidelines for lead-free products and the regulations prohibiting certain materials and is simultaneously recyclable. In addition, the production costs of the clamping body can be reduced as the addition of lead is no longer necessary. Furthermore, owing to the use of an aluminium-containing alloy for the clamping body pocket, the clamping body has a substantially lower weight than when the clamping body pocket is made of a brass-containing alloy, so a weight saving can also be achieved. Since the aluminium-containing alloy has a tensile strength of 380 N/mm$^2$ to 480 N/mm$^2$, the aluminium-containing alloy, and therefore the clamping body pocket, does not have any relaxation, or at least only a very small relaxation, so the functionality, in particular the clamping ability or the clamping force, of a clamping body of this type has a very long service life when clamping an electric conductor, without the clamping effect reducing, as the material of the clamping body pocket can be prevented from giving way and widening because of the tension applied by the clamping force owing to the good mechanical properties, in particular the high tensile strength of the material of the clamping body of 380 N/mm$^2$ to 480 N/mm$^2$. A tensile strength of 380 N/mm$^2$ to 480 N/mm$^2$ means here that the aluminium-containing alloy used as the material for the clamping body pocket has a tensile strength of 380 N/mm$^2$, 480 N/mm$^2$ or a value between 380 N/mm$^2$ and 480 N/mm$^2$.

According to a preferred configuration of the invention, the aluminium-containing alloy contains magnesium. The strength, in particular the tensile strength, of the aluminium-containing alloy, and therefore of the clamping body pocket, can be improved by the addition of magnesium to the aluminium-containing alloy, so a possible relaxation of the material of the clamping body pocket can be further reduced. The aluminium-containing alloy preferably has 0.35 to 1.2% by weight, preferably 0.6 to 1.2% by weight, of magnesium.

It is preferably provided that the aluminium-containing alloy has a copper content of ≤1.2% by weight. Owing to a copper content in the aluminium-containing alloy of ≤1.2% by weight, the aluminium-containing alloy has very good corrosion resistance, in particular very good resistance to contact corrosion, even without the aluminium-containing alloy, and therefore the clamping body pocket, having to be provided with an additional surface coating. The corrosion resistance remains constant over the service life and is independent of damage to the surface of the clamping body pocket consisting of an aluminium-containing alloy. An aluminium-containing alloy of this type also has significantly better corrosion resistance than steel materials provided with a surface coating.

It is furthermore advantageously provided that the aluminium-containing alloy has a silicon content of ≤1.4% by weight.

It is also preferably provided that the aluminium-containing alloy is a wrought aluminium alloy of the series 6000 Al—Mg—Si. The aluminium-containing alloy therefore preferably has the constituents aluminium (Al), magnesium (Mg) and silicon (Si). The wrought aluminium alloy of the series 6000 Al—Mg—Si is distinguished by very high corrosion resistance. In addition, the clamping body pocket formed from a wrought aluminium alloy of the series 6000 Al—Mg—Si has very good cutting ductility and very good formability and the material state remains stable even in a case of thermal operating stresses, in particular also with long-term loads, up to 150° C. Briefly higher temperatures to about 180° C. are also non-critical.

According to a particularly preferred configuration of the invention, it is provided that the aluminium-containing alloy is AlSi1MgCuMn (EN AW-6056). An aluminium-containing alloy of this type has a high strength, in particular a high tensile strength, very good corrosion resistance, very good machinability and formability, no relaxation behaviour or only a very small relaxation behaviour, so a clamping body pocket with an aluminium-containing alloy of this type has substantially the same properties as a clamping body pocket made of a brass-containing alloy provided with additions of lead, the clamping body pocket made of a corresponding aluminium-containing alloy having a lower weight and lower production costs than a clamping body pocket produced from a brass-containing alloy.

According to a further advantageous configuration of the invention, it is provided that the clamping body pocket is given a surface coating. The surface coating may, for example, be formed by a nickel coating. Before application of the nickel coating, the surface of the aluminium-containing alloy of the clamping body pocket is pickled, preferably zincate-pickled. Furthermore, the surface coating may also be provided in such a way that the surface of the aluminium-containing alloy of the clamping body pocket is anodised, so an aluminium oxide layer, known as a hard coat surface, which acts in an electrically insulating manner, is produced on the surface. Furthermore, it is possible to provide a copper sub-layer as the surface coating. However, it is also possible to provide no surface coating at all.

According to a further advantageous configuration of the invention, the clamping body pocket is formed from a solid profile. A solid profile means here that the clamping body pocket is produced from one piece, preferably a rectangular profiled wire, which is machined by milling, reaming and drilling to form a clamping body pocket with a receiving space for receiving an electric conductor and a threaded bore. Clamping body pockets of this type produced from a solid profile have previously generally been produced from a brass-containing alloy provided with additions of lead or from brass alloys with a lead proportion. Owing to the particularly good machinability of the clamping body pocket according to the invention produced from an aluminium-containing alloy, clamping body pockets of this type produced from a solid profile can now be produced from a solid profile having an aluminium-containing alloy, which has no additions of lead, but has substantially the same properties, in particular mechanical properties, as a clamping body pocket produced from a brass-containing alloy.

Alternatively, it is provided according to a further advantageous configuration of the invention that the clamping body pocket is formed from a bent strip-like element. Clamping body pockets of this type were previously generally produced from a steel material or a material with a brass-containing alloy. Compared to a clamping body pocket produced, in particular, from a steel material, a clamping body pocket according to the invention produced from an aluminium-containing alloy has, in particular, better corrosion resistance with equally good or better formability.

Furthermore, the invention relates to an electric terminal comprising a clamping body which is formed and developed as above.

The invention will be described in more detail below with reference to the accompanying drawings with the aid of a preferred embodiment.

Figure 1:
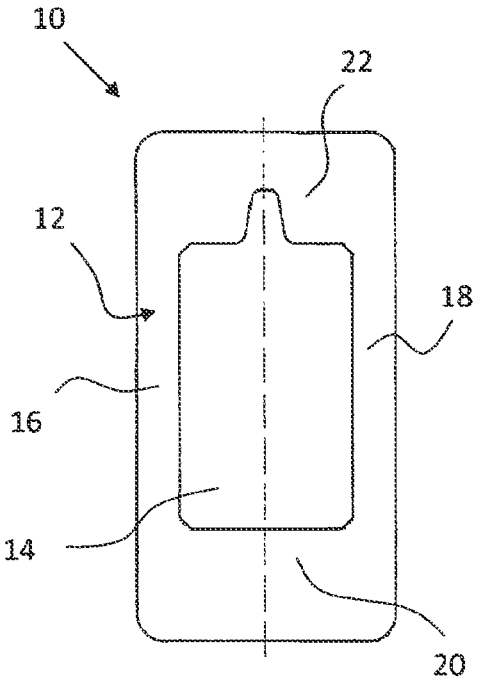
FIG. 1 shows a schematic diagram of a clamping body according to the invention in a side view.
Figure 2:
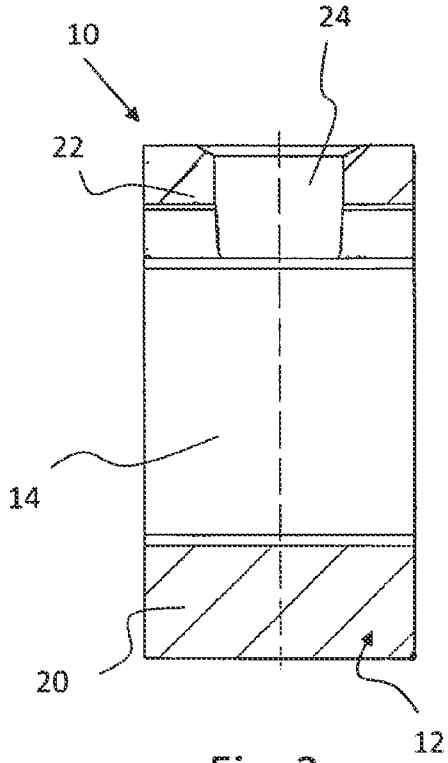
FIG. 2 shows a schematic sectional diagram of the clamping body according to the invention shown in FIG. 1.
Figure 3:
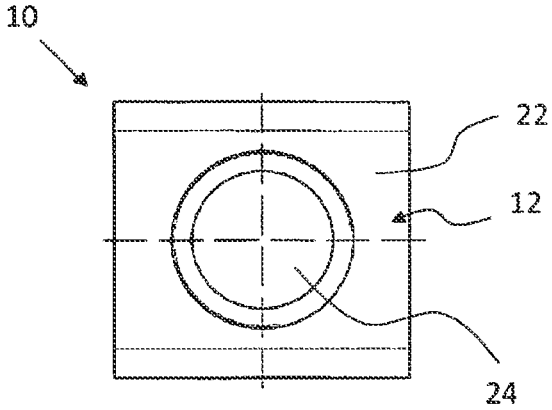
FIG. 3 shows a schematic diagram in the form of a plan view of the clamping body according to the invention shown in FIG. 1.

The clamping body 10 shown in FIGS. 1 to 3 has a clamping body pocket 12, which is formed from a solid profile and is produced by machining, in particular milling, reaming and drilling, from, for example, a rectangular profiled wire. The clamping body pocket 12 has a receiving space 14, which is in the form of a through-bore, as can be seen in FIG. 2, through which an electric conductor to be clamped and attached, not shown here, can be introduced. The receiving space 14 is delimited by a first lateral wall 16, a second lateral wall 18, a lateral wall 20 on the base side and a lateral wall 22 on the top side of the clamping body pocket 12.

As can be seen in FIG. 2, a threaded bore 24 to receive a screw, not shown here, is formed in the lateral wall 22 on the top side, by means of which screw the conductor introduced into the receiving space 14 can be clamped and attached.

FIG. 3 shows the terminal block in a plan view of the lateral wall 22 on the top side, in which the threaded bore 24 is provided.

The clamping body pocket 12 is formed from an electrically conductive lead-free aluminium-containing alloy, preferably AlSi1MgCuMn, which has a tensile strength between 380 $N/mm^2$ and 480 $N/mm^2$ and is distinguished by particularly good machinability, very good corrosion resistance, no relaxation properties, or only very small relaxation properties, low weight and low productions costs.

LIST OF REFERENCE NUMERALS

10 clamping body
12 clamping body pocket
14 receiving space
16 lateral wall
18 lateral wall
20 lateral wall
22 lateral wall
24 threaded bore

The invention claimed is:

1. A clamping body for an electric conductor comprising a clamping body pocket that forms a receiving space for receiving the electric conductor, a threaded bore being formed in lateral wall of the clamping body pocket to receive a screw, wherein the clamping body pocket is formed from an aluminium-containing alloy, which has a tensile strength of 380 $N/mm^2$ to 480 $N/mm^2$.

2. The clamping body of claim 1, wherein the aluminium-containing alloy contains magnesium.

3. The clamping body of claim 1, wherein the aluminium-containing alloy has a copper content of ≤1.2% by weight.

4. The clamping body of claim 1, wherein the aluminium-containing alloy has a silicon content of ≤1.4% by weight.

5. The clamping body of claim 1, wherein the aluminium-containing alloy is a wrought aluminium alloy of the series 6000 Al—Mg—Si.

6. The clamping body of claim 1, wherein the aluminium-containing alloy is AlSi1MgCuMn.

7. The clamping body of claim 1, wherein the clamping body pocket is provided with a surface coating.

8. The clamping body of claim 1, wherein the clamping body pocket is formed from a solid profile.

9. The clamping body of claim 1, wherein the clamping body pocket is formed from a bent strip-like element.

10. An electric terminal comprising the clamping body of claim 1.

* * * * *